US009478332B2

(12) United States Patent
Kuniyoshi et al.

(10) Patent No.: US 9,478,332 B2
(45) **Date of Patent: *Oct. 25, 2016**

(54) METHOD FOR PRODUCING R-T-B SINTERED MAGNET

(71) Applicant: HITACHI METALS, LTD., Minato-ku, Tokyo (JP)

(72) Inventors: Futoshi Kuniyoshi, Mishima-gun (JP); Rintaro Ishii, Mishima-gun (JP); Ryouichi Yamagata, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 87 days.

This patent is subject to a terminal disclaimer.

(21) Appl. No.: 14/372,543

(22) PCT Filed: Jan. 17, 2013

(86) PCT No.: PCT/JP2013/050780

§ 371 (c)(1),
(2) Date: Jul. 16, 2014

(87) PCT Pub. No.: WO2013/108830

PCT Pub. Date: Jul. 25, 2013

(65) Prior Publication Data

US 2014/0375404 A1 Dec. 25, 2014

(30) Foreign Application Priority Data

Jan. 19, 2012 (JP) ..... 2012-008956

(51) Int. Cl.
*H01F 1/057* (2006.01)
*H01F 1/053* (2006.01)
(Continued)

(52) U.S. Cl.
CPC ..... *H01F 1/0536* (2013.01); *B22F 3/24* (2013.01); *B22F 3/26* (2013.01); *B22F 9/023* (2013.01);
(Continued)

(58) Field of Classification Search
CPC .... H01F 41/0293; H01F 1/0577; H01F 7/02; B22F 3/24
See application file for complete search history.

(56) References Cited

U.S. PATENT DOCUMENTS

2008/0286595 A1* 11/2008 Yoshimura ..... B22F 7/062 428/548
2009/0297699 A1* 12/2009 Baba ..... H01F 41/0293 427/127

(Continued)

FOREIGN PATENT DOCUMENTS

EP 2 667 391 A1 11/2013
JP 2004-296973 A 10/2004

(Continued)

OTHER PUBLICATIONS

Official Communication issued in International Patent Application No. PCT/JP2013/050780, mailed on Apr. 16, 2013.

*Primary Examiner* — Jie Yang
*Assistant Examiner* — Xiaowei Su
(74) *Attorney, Agent, or Firm* — Keating & Bennett, LLP

(57) ABSTRACT

A method for producing a sintered R-T-B based magnet includes providing a sintered R-T-B based magnet body, of which the rare-earth-element mole fraction falls within the range of 31 mass % to 37 mass %; providing an RH diffusion source including a heavy rare-earth element RH (which is at least one of Dy and Tb) and 30 mass % to 80 mass % of Fe; loading the sintered magnet body and the RH diffusion source into a processing chamber so that the magnet body and the diffusion source are movable relative to each other and readily brought close to, or in contact with, each other; and performing an RH diffusion process by conducting a heat treatment on the sintered magnet body and the RH diffusion source at a process temperature of 700° C. to 1000° C. while moving the sintered magnet body and the RH diffusion source either continuously or discontinuously.

1 Claim, 2 Drawing Sheets

(51) Int. Cl.

| | |
|---|---|
| ***C22C 28/00*** | (2006.01) |
| ***C22C 38/00*** | (2006.01) |
| ***C22C 30/00*** | (2006.01) |
| ***C22C 38/06*** | (2006.01) |
| ***C22C 38/10*** | (2006.01) |
| ***C22C 38/16*** | (2006.01) |
| ***B22F 9/02*** | (2006.01) |
| ***H01F 41/02*** | (2006.01) |
| ***B22F 3/26*** | (2006.01) |
| ***H01F 7/02*** | (2006.01) |
| ***B22F 3/24*** | (2006.01) |
| *B22F 3/00* | (2006.01) |

(52) U.S. Cl.

CPC ..... *C22C 28/00* (2013.01); *C22C 30/00* (2013.01); *C22C 38/00* (2013.01); *C22C 38/001* (2013.01); *C22C 38/002* (2013.01); *C22C 38/005* (2013.01); *C22C 38/06* (2013.01); *C22C 38/10* (2013.01); *C22C 38/16* (2013.01); *H01F 7/02* (2013.01); *H01F 41/0293* (2013.01); *B22F 3/003* (2013.01); *B22F 2003/248* (2013.01); *B22F 2207/01* (2013.01); *B22F 2207/20* (2013.01); *H01F 1/0577* (2013.01)

(56) References Cited

U.S. PATENT DOCUMENTS

| | | | | |
|---|---|---|---|---|
| 2010/0282371 | A1* | 11/2010 | Sagawa | H01F 1/0557 148/302 |
| 2012/0112863 | A1* | 5/2012 | Kuniyoshi | B22F 3/24 335/302 |
| 2013/0026870 | A1 | 1/2013 | Baba et al. | |
| 2013/0087248 | A1* | 4/2013 | Kuniyoshi | B22F 3/24 148/101 |

FOREIGN PATENT DOCUMENTS

| | | | | |
|---|---|---|---|---|
| JP | 2012-109369 | A | 6/2012 | |
| WO | 2009/107397 | A1 | 9/2009 | |
| WO | WO 2011007758 | A1 * | 1/2011 | B22F 3/24 |
| WO | 2011/122667 | A1 | 10/2011 | |

* cited by examiner

METHOD FOR PRODUCING R-T-B SINTERED MAGNET

TECHNICAL FIELD

The present application relates to a method for producing a sintered R-T-B based magnet (where R is a rare-earth element and T is a transition metal element including Fe) including an $R_2T_{14}B$ type compound as its main phase.

BACKGROUND ART

A sintered R-T-B based magnet, including an $R_2T_{14}B$ type compound as its main phase, is known as a permanent magnet with the highest performance, and has been used in various types of motors such as a motor for a hybrid car and in numerous types of consumer electronic appliances. As a sintered R-T-B based magnet loses its coercivity at high temperatures, such a magnet will cause an irreversible flux loss. For that reason, when used in a motor, for example, the magnet should maintain coercivity that is high enough even at elevated temperatures to minimize the irreversible flux loss.

It is known that if R in the $R_2T_{14}B$ type compound phase is partially replaced with a heavy rare-earth element RH, the coercivity of a sintered R-T-B based magnet will increase. It is effective to add a lot of such a heavy rare-earth element RH to the sintered R-T-B based magnet to achieve high coercivity at a high temperature. However, if the light rare-earth element RL is replaced with the heavy rare-earth element RH as R in a sintered R-T-B based magnet, the coercivity (which will be referred to herein as "$H_{cJ}$") certainly increases but the remanence (which will be referred to herein as "$B_r$") decreases instead, which is a problem. Furthermore, as the heavy rare-earth element RH is one of rare natural resources, its use should be cut down.

For these reasons, various methods for increasing $H_{cJ}$ of a sintered magnet effectively without decreasing Br by adding as small an amount of the heavy rare-earth element RH as possible have recently been researched and developed.

Patent Document No. 1 discloses a method for producing a sintered R-T-B based magnet which includes the steps of: loading a sintered R-T-B based magnet body and an RH diffusion source including a metal or alloy of a heavy rare-earth element RH into a processing chamber so that the magnet body and the diffusion source are movable relative to each other and readily brought close to, or in contact with, each other; and performing an RH diffusion process by conducting a heat treatment on the sintered R-T-B based magnet body and the RH diffusion source at a temperature of 500° C. to 850° C. for at least 10 minutes while moving the magnet body and the diffusion source either continuously or discontinuously in the processing chamber. Such a method contributes to increasing $H_{cJ}$ without decreasing $B_r$ by diffusing a heavy rare-earth element RH such as Dy or Tb inward from the surface of a magnet material.

Patent Document No. 2 discloses a method for diffusing a heavy rare-earth element RH such as Dy inside from the surface of a sintered magnet body of an R-T-B based alloy while supplying the heavy rare-earth element RH onto the surface of the sintered magnet body (which will be referred to herein as an "evaporation diffusion process"). According to Patent Document No. 2, inside of a processing chamber made of a refractory metal material, the sintered R-T-B based magnet body and an RH bulk body are arranged so as to face each other with a predetermined gap left between them. The processing chamber includes a member for holding multiple sintered R-T-B based magnet bodies and a member for holding the RH bulk body. A method that uses such an apparatus requires a series of process steps of arranging the RH bulk body in the processing chamber, introducing a holding member and a net, putting the upper RH bulk body on the net, and sealing the processing chamber hermetically and carrying out an evaporation diffusion. These techniques have contributed to increasing $H_{cJ}$ without decreasing $B_r$ by using only a little Dy.

CITATION LIST

Patent Literature

Patent Document No. 1: PCT International Application Publication No. WO 2011/007758

Patent Document No. 2: PCT International Application Publication No. WO 2007/102391

Patent Document No. 3: PCT International Application Publication No. WO 2009/107397

SUMMARY OF INVENTION

Technical Problem

According to the method of Patent Document No. 1, even though the temperature is as low as 500° C. to 800° C., the heavy rare-earth element RH can still be supplied from the RH diffusion source to, and can be diffused inside, the sintered R-T-B based magnet body through the grain boundary, because the RH bulk body can be brought close to, or in contact with, the sintered R-T-B based magnet body.

According to the method of Patent Document No. 1, the heavy rare-earth element RH can be certainly supplied through the surface of the sintered R-T-B based magnet body. However, the rate of diffusion inside the sintered R-T-B based magnet body is so low in that temperature range that it will take a long time to get the heavy rare-earth element RH diffused sufficiently inside the sintered R-T-B based magnet body.

In addition, according to the method of Patent Document No. 1, if Dy or Tb metal, a Dy alloy including more than 70 mass % of Dy, or a Tb alloy including more than 70 mass % of Tb is used as the RH diffusion source, then the sintered R-T-B based magnet body would adhere to the RH diffusion source at a processing temperature of 850° C. or more. That is why the rate of diffusion inside the sintered R-T-B based magnet body cannot be increased by raising the processing temperature, and therefore, an RH diffusion process temperature exceeding 850° C. cannot be adopted.

On top of that, if an RH diffusion source including a heavy rare-earth element RH (which is at least one of Dy and Tb) and 30 mass % to 80 mass % of Fe is used, the RH diffusion source will not easily react with Nd or Pr leaking out of the sintered R-T-B based magnet, and therefore, the composition will not change into an unexpected one. Nevertheless, at that low RH diffusion process temperature of 850° C. or less, the efficiency is too low to avoid taking a lot of time to get the process done.

On the other hand, according to the method of Patent Document No. 2, the sintered R-T-B based magnet body and the RH bulk body including the heavy rare-earth element RH need to be arranged in the processing chamber with a gap left between them. That is why it takes a lot of time and trouble to perform the arranging process step and its mass productivity is inferior to other methods.

In addition, since Dy or Tb needs to be supplied by subliming it, it takes a long time to achieve higher coercivity by increasing the rate of diffusion of the heavy rare-earth element RH into the sintered R-T-B based magnet body. Among other things, Tb has a lower saturated vapor pressure than Dy, and therefore, it is particularly difficult to increase its rate of diffusion sufficiently.

Moreover, according to the method of Patent Document No. 2, the RH diffusion source diffuses more easily inside the sintered R-T-B based magnet body than in the method of Patent Document No. 1. As disclosed in Patent Document No. 3, supposing the contents of a rare-earth element, oxygen, carbon, and nitrogen are X (mass %), ZO (mass %), ZC (mass %) and ZN (mass %) and supposing ZO+ZC+ZN=Y (mass %), unless a sintered R—Fe—B based rare-earth magnet body which satisfies the relations $25 \leq X \leq 40$, $(0.114X-3.17) \leq Y \leq (0.157X-4.27)$, $0 < ZO \leq 0.5$, $0 < ZC \leq 0.1$ and $0 < ZN \leq 0.1$ is used, the sintered R—Fe—B based magnet body would adhere to the jig during the RH diffusion process, which is a problem.

An embodiment of the present invention provides a method for producing a sintered R-T-B based magnet which contributes to getting a heavy rare-earth element RH diffused inside a sintered R-T-B based magnet body (i.e., a magnet yet to be subjected to an RH diffusion process) in a short time and increasing $H_{cJ}$ without decreasing $B_r$.

According to an embodiment of the present invention, a method for producing a sintered R-T-B based magnet, by which the sintered R-T-B based magnet body and the RH diffusion source never adhere to each other even when the RH diffusion process is carried out in a broad temperature range of 700° C. to 1000° C. and by which the heavy rare-earth element RH can get diffused inside the sintered R-T-B based magnet body, can be provided.

Solution to Problem

A method for producing a sintered R-T-B based magnet according to an aspect of the present invention includes the steps of: providing a sintered R-T-B based magnet body, of which the R mole fraction that is defined by the content of a rare-earth element falls within the range of 31 mass % to 37 mass %; providing an RH diffusion source including a heavy rare-earth element RH (which is at least one of Dy and Tb) and 30 mass % to 80 mass % of Fe; loading the sintered magnet body and the RH diffusion source into a processing chamber so that the magnet body and the diffusion source are movable relative to each other and readily brought close to, or in contact with, each other; and performing an RH diffusion process by conducting a heat treatment on the sintered magnet body and the RH diffusion source at a process temperature of 700° C. to 1000° C. while moving the sintered magnet body and the RH diffusion source either continuously or discontinuously in the processing chamber.

Advantageous Effects of Invention

With a method for producing a sintered R-T-B based magnet according to an embodiment of the present disclosure, a heavy rare-earth element RH can get diffused inside a sintered R-T-B based magnet body in a short time and $H_{cJ}$ can be increased significantly without causing a decrease in $B_r$.

Also, with a method for producing a sintered R-T-B based magnet according to an embodiment of the present disclosure, the RH diffusion process can be carried out without allowing the sintered R-T-B based magnet body and the RH diffusion source to adhere to each other even in a high temperature range of 700° C. to 1000° C.

DESCRIPTION OF EMBODIMENTS

Figure 1:
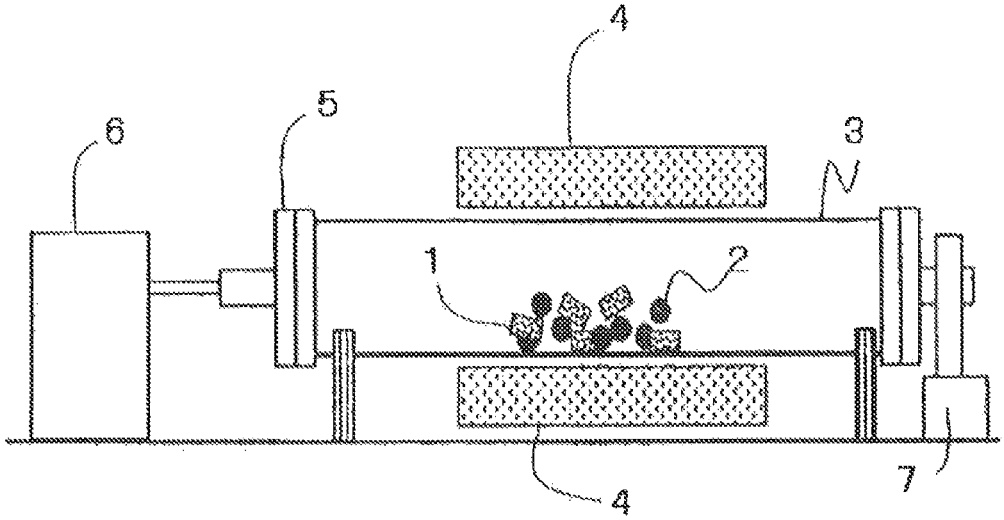
FIG. 1 A cross-sectional view schematically illustrating a configuration for a diffusion system for use in an embodiment of the present invention.

In a manufacturing process according to an embodiment of the present invention, a sintered R-T-B based magnet body and an RH diffusion source are loaded into a processing chamber (or a process vessel) so as to be movable relative to each other and readily brought close to, or in contact with, each other, and then are heated to, and maintained at, a temperature (i.e., process temperature) of 700° C. to 1000° C. The process temperature may be set to fall within the range of 860° C. to 970° C.

In this case, by rotating, rocking or shaking the processing chamber, for example, the sintered R-T-B based magnet body and the RH diffusion source may be moved either continuously or discontinuously in the processing chamber, thereby changing the point of contact between the sintered R-T-B based magnet body and the RH diffusion source. Also, the heavy rare-earth element RH vaporized (sublimed) can not only be supplied but also be diffused inside the sintered R-T-B based magnet body simultaneously while the sintered R-T-B based magnet body and the RH diffusion source are either brought close to, or spaced part from, each other. This process step will be referred to herein as an "RH diffusion process step".

In this case, in a sintered R-T-B based magnet body according to an embodiment, the R mole fraction which is defined by the content of a rare-earth element falls within the range of 31 mass % to 37 mass %, and the effective rare-earth content ((R mole fraction (mass %)−((6×O mole fraction (mass %)+8×C mole fraction (mass %)+10×N mole fraction (mass %), where the O mole fraction indicates the oxygen content, the C mole fraction indicates the carbon content, and the N mole fraction indicates the nitrogen content) falls within the range of 28 mass % to 35 mass %.

According to an embodiment of the present invention, by moving a sintered R-T-B based magnet body, of which the R mole fraction falls within the range of 31 mass % to 37 mass %, along with an RH diffusion source including 30 mass % to 80 mass % of Fe either continuously or discontinuously at a temperature of 700° C. to 1000° C., the RH diffusion source and the sintered R-T-B based magnet body can be brought into contact with each other at an increased number of points in the processing chamber, and the heavy rare-earth element RH can get diffused inside the sintered R-T-B based magnet body. In addition, in the temperature range of 700° C. to 1000° C., the RH diffusion is promoted in the sintered R-T-B based magnet. Consequently, the RH diffusion can be carried out in a state where the heavy rare-earth element RH can get diffused easily in the sintered magnet body.

A sintered R-T-B based magnet body according to an embodiment of the present invention has an R mole fraction of 31 mass % to 37 mass %. Thus, the ratio of an R-rich phase in the sintered R-T-B based magnet body increases and its grain boundary broadens, too. As a result, the amount of the heavy rare-earth element RH introduced from the surface of the magnet into the grain boundary increases and the coercivity can be increased more effectively in a short time through the RH diffusion process. The R mole fraction suitably falls within the range of 31 mass % to 34 mass %.

If the R mole fraction were less than 31 mass %, the amount of RH introduced from the surface of the magnet into the grain boundary, where the percentage of the R-rich phase is low from the beginning, would be too small to achieve the coercivity increasing effect of the present invention as intended. However, if the R mole fraction were greater than 37 mass %, then the amount of the rare-earth element leaking out onto the surface of the sintered body could be too much to avoid causing adhesion.

Furthermore, if a sintered R-T-B based magnet body according to an embodiment of the present invention has an R mole fraction of 31 mass % to 37 mass % and an effective rare-earth content of 28% to 35%, the sintered R-T-B based magnet body comes to include the R-rich phase at a further increased percentage and have an even broader grain boundary. As a result, the amount of the heavy rare-earth element RH introduced from the surface of the magnet into the grain boundary through the RH diffusion process increases so much that the coercivity can be increased more effectively in a short time. The R mole fraction suitably falls within the range of 31 mass % to 34 mass % and the effective rare-earth content suitably falls within the range of 28 mass % to 32 mass %.

In addition, if the R mole fraction falls within the range of 31 mass % to 37 mass % and the effective rare-earth content falls within the range of 28 mass % to 35 mass %, the RH compound such as an R oxide decreases in the R-rich phase, and an increased amount of the heavy rare-earth element RH is introduced from the surface of the magnet into the grain boundary. As a result, the coercivity can be increased even more effectively.

If the R mole fraction were less than 31 mass %, the amount of RH introduced from the surface of the magnet into the grain boundary, where the percentage of the R-rich phase is low from the beginning, would be too small to achieve the coercivity increasing effect of the present invention as intended, even if the effective rare-earth content falls within the range of 28 mass % to 35 mass %. However, if the R mole fraction were greater than 37 mass %, then the amount of the rare-earth element leaking out onto the surface of the sintered body could be too much to avoid causing adhesion.

If the effective rare-earth content were less than 28 mass %, there would be so much stabilized R compound in the R-rich phase that RH would be introduced into the surface region of the magnet too little to achieve the coercivity increasing effect as intended. However, if the effective rare-earth content were greater than 35 mass %, then the amount of the rare-earth element leaking out onto the surface of the sintered body could be too much to avoid causing adhesion.

The RH diffusion source is an alloy including a heavy rare-earth element RH (which is at least one of Dy and Tb) and 30 mass % to 80 mass % of Fe.

By using an alloy including the heavy rare-earth element RH and 30 mass % to 80 mass % of Fe as the RH diffusion source, it is possible to prevent the RH diffusion source from getting altered by Nd or Pr that leaks out of the sintered R-T-B based magnet body during the RH diffusion process.

On top of that, an RH diffusion source according to an embodiment of the present invention does not react with the sintered R-T-B based magnet easily. That is why even if the RH diffusion process is carried out at a temperature of 700° C. to 1000° C., it is possible to avoid supplying an excessive amount of heavy rare-earth element RH (which is at least one of Dy and Tb) onto the surface of the sintered R-T-B based magnet. As a result, sufficiently high $H_{cJ}$ can be achieved with a decrease in $B_r$ after the RH diffusion process suppressed.

In this case, if Fe accounted for less than 30 mass % of the RH diffusion source, then the volume percentage of the RH phase would increase so much that Nd or Pr leaking out of the sintered R-T-B based magnet body during the RH diffusion process would be absorbed into the RH diffusion source and react with Fe, thus shifting the composition of the RH diffusion source and altering its property. On the other hand, if Fe accounted for more than 80 mass %, then the RH content would be less than 20 mass %, the amount of the heavy rare-earth element RH supplied from the RH diffusion source would decrease, and it would take a very long time to get the diffusion process done. That is why in order to mass produce the magnets, it is not appropriate to use that high Fe content.

The mass percentage of Fe included in the RH diffusion source is suitably 40 mass % to 80 mass %, and more suitably 40 mass % to 60 mass %. In the preferred range, the volume percentage of an $RHFe_2$ compound such as $DyFe_2$, and/or an $RHFe_3$ compound such as $DyFe_3$, included in the RH diffusion source becomes 90% or more.

According to an embodiment of the present invention, the sintered R-T-B based magnet body and the RH diffusion source are loaded into a processing chamber so as to be movable relative to each other and readily brought close to, or in contact with, each other. Thus, it is possible to prevent Nd or Pr leaking out of the sintered R-T-B based magnet body from causing adhesion between the sintered R-T-B based magnet bodies themselves, between the sintered R-T-B based magnet body and the RH diffusion source, or between the sintered R-T-B based magnet body and the jig, during the RH diffusion process.

In addition, since the sintered R-T-B based magnet body and the RH diffusion source can be loaded into the processing chamber so as to be movable relative to each other and be readily brought close to, or in contact with, each other and can be moved either continuously or discontinuously, the time it would otherwise take to arrange the sintered R-T-B based magnet body and the RH diffusion source at predetermined positions can be saved.

In a combination of a rare-earth element and Fe, if the rare-earth element is Nd or Pr, no 1-2 or 1-3 compound is produced. Consequently, if the RH diffusion source has a composition ratio of 1-2 or 1-3, it is possible to prevent the RH diffusion source from absorbing Nd or Pr leaking out of the sintered R-T-B based magnet body during the RH diffusion process. As a result, the RH diffusion source never gets altered and can be used repeatedly an even larger number of times.

In addition, the heavy rare-earth element RH is never supplied excessively onto the sintered R-T-B based magnet body and the remanence $B_r$ no longer decreases in the RH diffusion process.

As for a method for moving the sintered R-T-B based magnet body and the RH diffusion source in the processing chamber either continuously or discontinuously during the RH diffusion process, as long as the RH diffusion source and the sintered R-T-B based magnet body can have their relative positions changed without making the sintered R-T-B based magnet body chip or fracture, any arbitrary method may be used. For example, the processing chamber may be rotated, rocked or subjected to externally applied vibrations. Alternatively, stirring means may be provided in the processing chamber.

If the magnetocrystalline anisotropy of a sintered R-T-B based magnet is increased on the outer periphery of its main phase crystal grains, the coercivity $H_{cJ}$ of the entire magnet is said to increase effectively. According to an embodiment of the present invention, the heavy rare-earth element replaced layer can be formed on the outer periphery of the main phase not just in a region close to the surface of the sintered R-T-B based magnet body but also in a region deep under the surface of the sintered R-T-B based magnet body. That is why by forming such a layer including the heavy rare-earth element RH in an increased concentration efficiently on the outer periphery of the main phase over the entire sintered R-T-B based magnet body, not just $H_{cJ}$ can be increased but also $B_r$ hardly decreases because a portion with a low heavy rare-earth element RH concentration remains inside the main phase.

Hereinafter, the diffusion process step to be carried out on a sintered R-T-B based magnet body according to an embodiment of the present invention will be described in detail.

Sintered R-T-B Based Magnet Body

First of all, according to an embodiment of the present invention, a sintered R-T-B based magnet body in which the heavy rare-earth element RH needs to diffuse is provided.

Hereinafter, a preferred embodiment of a method for producing a sintered R-T-B based magnet according to the present invention will be described.

Material Alloy

First, an alloy including 25 mass % to 40 mass % of a rare-earth element R, 0.6 mass % to 1.6 mass % of B (boron) and Fe and inevitably contained impurities as the balance is provided. A portion of B may be replaced with C (carbon) and a portion (50 at % or less) of Fe may be replaced with Co. For various purposes, this alloy may contain 0.01 mass % to 1.0 mass % of at least one additive element M which is selected from the group consisting of Al, Si, Ti, V, Cr, Mn, Ni, Cu, Zn, Ga, Zr, Nb, Mo, Ag, In, Sn, Hf, Ta, W, Pb and Bi.

In this case, most of the rare-earth element R is at least one element that is selected from the light rare-earth elements RL (Nd, Pr) but that may include a heavy rare-earth element as well. The heavy rare-earth element, if any, suitably includes at least one of Dy and Tb.

Such an alloy is suitably made by quenching a melt by strip casting method, for example. Hereinafter, a method of making a rapidly solidified material alloy by strip casting method will be described.

First, an alloy with the composition described above is melted by an induction heating process within argon ambient to make a melt of the alloy. Next, this melt is kept heated to about 1350° C. and then quenched by single roller process, thereby obtaining a flake-like alloy with a thickness of about 0.3 mm. Then, the flake-like alloy thus obtained is pulverized to a size of 1 mm to 10 mm before being subjected to the next hydrogen pulverization process. Such a method of making a material alloy by strip casting method is disclosed in U.S. Pat. No. 5,383,978, for example.

Coarse Pulverization Process

Next, the flake-like material alloy block is loaded into a hydrogen furnace and then subjected to a hydrogen pulverization process within the hydrogen furnace. When the hydrogen pulverization process is over, the coarsely pulverized powder is suitably unloaded from the hydrogen furnace in an inert ambient so as not to be exposed to the air. This should prevent the coarsely pulverized powder from being oxidized or generating heat and would eventually minimize the deterioration of the magnetic properties of the resultant magnet. The coarse powder is so active that a lot more oxygen would be absorbed when the powder is handled in the air. For that reason, the powder is suitably handled in an inert gas such as nitrogen or Ar gas.

As a result of this hydrogen pulverization process, the flake-like material alloy is pulverized to sizes of about 0.1 mm to 3 mm. After the hydrogen pulverization, the embrittled material alloy is suitably further crushed to finer sizes and cooled.

Fine Pulverization Process

Next, the coarsely pulverized powder is finely pulverized with a jet mill pulverizing machine. A cyclone classifier is connected to the jet mill pulverizing machine for use in this embodiment. The jet mill pulverizing machine is fed with the coarsely pulverized powder that has been coarsely pulverized in the coarse pulverization process and gets the powder further pulverized by its pulverizer. The powder which has been pulverized by the pulverizer is then collected in a collecting tank by way of the cyclone classifier. In this manner, a finely pulverized powder with sizes of about 0.1 μm to about 20 μm (typically an F. S. S. S. particle size of 3 μm to 5 μm) can be obtained. The pulverizing machine for use in such a fine pulverization process does not have to be a jet mill but may also be an attritor or a ball mill. Optionally, before the fine pulverization process, a lubricant such as zinc stearate may be added as an aid for the pulverization process. The pulverization aid may be added and mixed at 0.1 mass % to 0.3 mass %, for example, because the C mole fraction would increase if the aid was added too much. As the pulverization gas, nitrogen gas is generally used. However, a rare gas such as He or Ar gas may be used to avoid nitrification. Furthermore, to reduce the oxygen content in the magnet to a predetermined range, the fine pulverization may be carried out in an ambient with a small oxygen content. Or the finely pulverized powder may be turned into slurry by introducing the powder into some fluid.

Press Compaction Process

In this embodiment, a lubricant is added to the finely pulverized powder obtained by the method described above. The lubricant may be added and mixed at 0.2 mass % to 0.4 mass %, for example, because the C mole fraction would increase if the lubricant was added too much. Next, the finely pulverized powder prepared by the method described above is compacted under an aligning magnetic field using a known press machine, thereby making a compact. The aligning magnetic field to be applied may have a strength of 0.8 to 1.2 MA/m, for example. Also, the compacting pressure is set so that the green compact will have a green density of 4 g/cm$^3$ to 4.3 g/cm$^3$. It is recommended that the press compaction process be carried out in an inert gas so that the finely pulverized powder and green compact are not exposed to the air.

Sintering Process

The compact thus obtained is then sintered at a temperature of 1000° C. to 1200° C. The ambient may be either a vacuum or low pressure argon ambient. Optionally, while the temperature is being increased, hydrogen gas may be introduced into a vacuum. When the sintering process is over, a heat treatment may be carried out at a temperature of 400° C. to 1000° C. or machining may be carried out to adjust its size.

In an embodiment of the present invention, the sintered R-T-B based magnet body is made so that the R mole fraction falls within the range of 31 mass % to 37 mass % during each of the material alloy preparing, coarse pulverization, fine pulverization, press compaction, and sintering process steps and in an interval between these process steps.

To control the effective rare-earth content within the range of 28 mass % to 35 mass %, in the sintered R-T-B based magnet body that has just been sintered, the O, C and N mole fractions are controlled to fall within the ranges of 0.05 to 0.5 mass %, 0.01 to 0.1 mass %, and 0.01 to 0.1 mass %, respectively.

The O mole fraction may be controlled by determining in what ambient the coarsely pulverized powder should be handled and how much oxygen should be introduced during the fine pulverization process.

The C mole fraction may be controlled by determining what kind of pulverization aid should be selected, how much the pulverization aid should be introduced, what kind of lubricant should be selected, and how much the lubricant should be introduced.

And the N mole fraction is controlled by determining whether the pulverization gas should be one of nitrogen, argon and helium gases or a mixture of nitrogen and argon gases.

Composition of Sintered R-T-B Based Magnet Body

A sintered R-T-B based magnet body according to an embodiment of the present invention has a composition including:

31 to 37 mass % of R;

0.85 to 1.2 mass % of B (a portion of which may be replaced with C);

0 to 2 mass % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and T (which is a transition metal consisting mostly of Fe but which may include Co) and inevitable impurities as the balance.

In this composition, R indicates the combined content of Nd, Pr, Dy and Tb among the rare-earth elements. Most of R is at least one element which is selected from Nd and Pr that are light rare-earth elements RL but that may include at least one of Dy and Tb that are heavy rare-earth elements.

The effective rare-earth content is suitably set to fall within the range of 28 mass % to 35 mass %.

The effective rare-earth content may be calculated by the following equation:

Effective rare-earth content=R mole fraction (mass %)−(6×O mole fraction (mass %)+8×C mole fraction (mass %)+10×N mole fraction (mass %))

In this equation, the coefficients by which the O, C and N mole fraction are multiplied are calculated based on the products of these impurities' compounds ($Nd_2O_3$, $Nd_2C_3$, NdN) and their weights.

RH Diffusion Source

The RH diffusion source is an alloy including a heavy rare-earth element RH and 30 mass % to 80 mass % of Fe, and may have any arbitrary shape (e.g., in the form of a ball, a wire, a plate, a block or powder). If the RH diffusion source has a ball shape or a wire shape, its diameter may be set to be a few millimeters to several centimeters. But if the RH diffusion source has a powder shape, its particle size may fall within the range of 0.05 mm to 5 mm. In this manner, the shape and size of the RH diffusion source are not particularly limited.

Unless the effects of this embodiment of the present invention are lessened, the RH diffusion source may include at least one element selected from the group consisting of Nd, Pr, La, Ce, Zn, Sn, and Co.

In addition, the RH diffusion source may further include, as inevitable impurities, at least one element selected from the group consisting of Al, Ti, V, Cr, Mn, Ni, Cu, Zn, Ga, Zr, Nb, Mo, Ag, In, Hf, Ta, W, Pb, Si and Bi.

Stirring Aid Member

In an embodiment of the present invention, it is recommended that a stirring aid member, as well as the sintered R-T-B based magnet body and the RH diffusion source, be introduced into the processing chamber. The stirring aid member plays the roles of promoting the contact between the RH diffusion source and the sintered R-T-B based magnet body and indirectly supplying the heavy rare-earth element RH that has been once deposited on the stirring aid member itself to the sintered R-T-B based magnet body. Added to that, the stirring aid member also prevents chipping or adhesion due to a collision between the sintered R-T-B based magnet bodies or between the sintered R-T-B based magnet body and the RH diffusion source in the processing chamber.

The stirring aid member suitably has a shape that makes it easily movable in the processing chamber. And it is effective to rotate, rock or shake the processing chamber by combining that stirring aid member with the sintered R-T-B based magnet body and the RH diffusion source. Such a shape that makes the stirring aid member easily movable may be a sphere, an ellipsoid, or a circular cylinder with a diameter of several hundred μm to several ten mm.

It is preferred that the stirring aid member be made of a material that has almost the same specific gravity as the sintered magnet body and that does not react easily with the sintered R-T-B based magnet body or the RH diffusion source even if the member contacts with the sintered R-T-B based magnet body or the RH diffusion source during the RH diffusion process. The stirring aid member is suitably made of zirconia, silicon nitride, silicon carbide, boron nitride or a ceramic that includes any combination of these compounds. Alternatively, the stirring aid member may also be made of an element belonging to the group including Mo, W, Nb, Ta, Hf and Zr or a mixture thereof.

RH Diffusion Process

Hereinafter, an example of a preferred diffusion process step according to an embodiment of the present invention will be described with reference to FIG. 1. In the example illustrated in FIG. 1, sintered R-T-B based magnet bodies 1 and RH diffusion sources 2 have been loaded into a cylinder 3 of stainless steel. Although not shown in FIG. 1, it is recommended that zirconia balls, for example, be introduced as stirring aid members into the cylinder 3. In this example, the cylinder 3 functions as the "processing chamber". The cylinder 3 does not have to be made of stainless steel but may also be made of any other arbitrary material as long as the material has thermal resistance that is high enough to withstand a temperature of 700° C. to 1000° C. and hardly reacts with the sintered R-T-B based magnet bodies 1 or the RH diffusion sources 2. For example, the cylinder 3 may also be made of Nb, Mo, W or an alloy including at least one of these elements. The cylinder 3 has a cap 5 that can be opened and closed or removed. Optionally, projections may be arranged on the inner wall of the cylinder 3 so that the RH diffusion sources and the sintered magnet bodies can move and contact with each other efficiently. A cross-sectional shape of the cylinder 3 as viewed perpendicularly to its longitudinal direction does not have to be circular but may also be elliptical, polygonal or any other arbitrary shape. In the example illustrated in FIG. 1, the cylinder 3 is connected to an exhaust system 6. The exhaust system 6 can lower the pressure inside of the cylinder 3. An inert gas such as Ar may be introduced from a gas cylinder (not shown) into the cylinder 3.

The cylinder 3 is heated by a heater 4 which is arranged around the outer periphery of the cylinder 3. When the cylinder 3 is heated, the sintered R-T-B based magnet bodies 1 and the RH diffusion sources 2 that are housed inside the cylinder 3 are also heated. The cylinder 3 is supported rotatably on its center axis and can also be rotated by a motor 7 even while being heated by the heater 4. The rotational velocity of the cylinder 3, which is represented by a surface velocity at the inner wall of the cylinder 3, may be set to be 0.01 m per second or more. The rotational velocity of the cylinder 3 is suitably set to be 0.5 m per second or less so as to prevent the sintered R-T-B based magnet bodies in the cylinder from colliding against each other violently and chipping due to the rotation.

In the example illustrated in FIG. 1, the cylinder is supposed to be rotating. However, according to the present invention, as long as the sintered R-T-B based magnet bodies 1 and the RH diffusion sources 2 are movable relative to each other and can contact with each other in the cylinder 3 during the RH diffusion process, the cylinder 3 does not always have to be rotated but may also be rocked or shaken. Or the cylinder 3 may even be rotated, rocked and/or shaken in combination at the same time.

Next, it will be described how to carry out an RH diffusion process using the processing apparatus shown in FIG. 1. First of all, the cap 5 is removed from the cylinder 3, thereby opening the cylinder 3. And after multiple sintered R-T-B based magnet bodies 1 and RH diffusion sources 2 have been loaded into the cylinder 3, the cap 5 is attached to the cylinder 3 again. Then the inner space of the cylinder 3 is evacuated with the exhaust system 6 connected. When the internal pressure of the cylinder 3 becomes sufficiently low, the exhaust system 6 is disconnected. After heating, an inert gas is introduced until the pressure reaches the required level, and the cylinder 3 is heated by the heater 4 while being rotated by the motor 7.

During the diffusion heat treatment, an inert ambient is suitably maintained in the cylinder 3. In this description, the "inert ambient" refers herein to a vacuum or an inert gas. Also, the "inert gas" may be a rare gas such as argon (Ar) gas but may also be any other gas as long as the gas is not chemically reactive between the sintered magnet bodies 1 and the RH diffusion sources 2. The pressure of the inert gas is suitably equal to, or lower than, the atmospheric pressure. If the pressure of the ambient gas inside the cylinder 3 were close to the atmospheric pressure, then the heavy rare-earth element RH would not be supplied easily from the RH diffusion sources 2 onto the surface of the sintered magnet bodies 1 according to the technique disclosed in Patent Document No. 1, for example. However, since the RH diffusion sources 2 and the sintered R-T-B based magnet bodies 1 are arranged either close to, or in contact with, each other, according to this embodiment, the RH diffusion process can be carried out at a pressure of $10^{-2}$ Pa to the atmospheric pressure. Also, there is relatively weak correlation between the degree of vacuum and the amount of RH supplied. Thus, even if the degree of vacuum were further increased, the amount of the heavy rare-earth element RH supplied (and eventually the degree of increase in coercivity) would not change significantly. The amount supplied is more sensitive to the temperature of the sintered R-T-B based magnet bodies than the pressure of the ambient.

In this embodiment, the RH diffusion sources 2 including the heavy rare-earth element RH and the sintered R-T-B based magnet bodies 1 are heated while being rotated together, thereby supplying the heavy rare-earth element RH from the RH diffusion sources 2 onto the surface of the sintered R-T-B based magnet bodies 1 and diffusing the heavy rare-earth element RH inside of the sintered magnet bodies at the same time.

During the diffusion process, the surface velocity at the inner wall of the processing chamber may be set to be 0.01 m/s or more, for example. If the rotational velocity were too low, the point of contact between the sintered R-T-B based magnet bodies and the RH diffusion sources would shift so slowly as to cause adhesion between them easily. That is why the higher the diffusion temperature, the higher the rotational velocity of the processing chamber should be. A suitable rotational velocity varies according to not just the diffusion temperature but also the shape and size of the RH diffusion source as well.

In this embodiment, the temperature of the RH diffusion sources 2 and the sintered R-T-B based magnet bodies is suitably maintained within the range of 700° C. to 1000° C. This is a proper temperature range for the heavy rare-earth element RH to diffuse inward in the internal structure of the sintered R-T-B based magnet bodies 1 through the grain boundary.

Each of the RH diffusion sources 2 includes the heavy rare-earth element RH and 30 mass % to 80 mass % of Fe. And the heavy rare-earth element RH would not be supplied excessively at a temperature of 700° C. to 1000° C. The heat treatment process may be carried out for 10 minutes to 72 hours, and suitably for 1 to 12 hours.

In addition, since the volume percentage of $RHFe_2$ or $RHFe_2$ accounts for most of the RH diffusion source 2, Nd or Pr leaking out of the sintered R-T-B based magnet body 1 will not be absorbed into the RH diffusion source 2. As a result, the RH diffusion source does not get altered easily.

If the process temperature were higher than 1000° C., the RH diffusion sources 2 and the sintered R-T-B based magnet bodies 1 would easily adhere to each other, which should be avoided. Nevertheless, if the process temperature were lower than 700 AD, it would take a lot of time to get the process done.

The amount of time for maintaining that temperature is determined by the ratio of the total volume of the sintered R-T-B based magnet bodies 1 loaded to that of the RH diffusion sources 2 loaded during the RH diffusion process step, the shape of the sintered R-T-B based magnet bodies 1, the shape of the RH diffusion sources 2, the rate of diffusion of the heavy rare-earth element RH into the sintered R-T-B based magnet bodies 1 through the RH diffusion process (which will be referred to herein as a "diffusion rate") and other factors.

The pressure of the ambient gas during the RH diffusion process (i.e., the pressure of the ambient inside the processing chamber) may be set to fall within the range of $10^{-2}$ Pa to the atmospheric pressure, for example.

Optionally, after the RH diffusion process, the sintered R-T-B based magnet bodies 1 may be subjected to a first heat treatment process in order to distribute more uniformly the heavy rare-earth element RH diffused. In that case, after the RH diffusion sources have been removed, the first heat treatment process is carried out within the temperature range of 700° C. to 1000° C. in which the heavy rare-earth element RH can diffuse substantially, more suitably within the range of 870° C. to 970° C. In this first heat treatment process, no heavy rare-earth element RH is further supplied onto the sintered R-T-B based magnet bodies 1 but the heavy rare-earth element RH does diffuse inside of the sintered R-T-B based magnet bodies 1. As a result, the heavy rare-earth element RH diffusing can reach deep inside under the surface of the sintered magnets, and the magnets as a whole can eventually have increased coercivity. The first heat treatment process may be carried out for a period of time of 10 minutes to 72 hours, for example, and suitably for 1 to 12 hours. In this case, the pressure of the ambient in the heat treatment furnace where the first heat treatment process is carried out is equal to or lower than the atmospheric pressure and is suitably 100 kPa or less.

Second Heat Treatment Process

Also, if necessary, a second heat treatment process may be further carried out at a temperature of 400° C. to 700° C. However, if the second heat treatment process (at 400° C. to 700° C.) is conducted, it is recommended that the second heat treatment process be carried out after the first heat treatment process (at 700° C. to 1000° C.). The first heat treatment process (at 700° C. to 1000° C.) and the second heat treatment process (at 400° C. to 700° C.) may be performed in the same processing chamber. The second heat treatment process may be performed for a period of time of 10 minutes to 72 hours, and suitably performed for 1 to 12 hours. In this case, the pressure of the ambient in the heat treatment furnace where the second heat treatment process is carried out is equal to or lower than the atmospheric pressure and is suitably 100 kPa or less. Optionally, only the second heat treatment process may be carried out with the first heat treatment process omitted.

Experimental Example 1

Effects of Limited R Mole Fraction

First of all, sintered bodies with the compositions shown in Table 1 were made. Hereinafter, it will be described in what procedure those sintered bodies were made. First, their compositions were adjusted to be the ones shown in Table 1 and thin alloy flakes with a thickness of 0.2 mm to 0.3 mm were made by strip casting method. Next, a vessel was loaded with those thin alloy flakes and then introduced into a hydrogen treatment system, which was filled with a hydrogen gas at a pressure of 50 kPa. In this manner, hydrogen was absorbed into the thin alloy flakes at room temperature and then desorbed. By performing such a hydrogen treatment, the thin alloy flakes were embrittled to obtain a powder in indefinite shapes with sizes of about 0.15 mm to about 2 mm. Thereafter, 0.05 mass % of zinc stearate was added as pulverization aid to the coarsely pulverized powder obtained by the hydrogen treatment described above and then the mixture was pulverized with a jet mill machine to obtain a fine powder with a particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1040° C. for four hours in a vacuum furnace. In this manner, sintered R-T-B based magnet bodies were made.

Those sintered bodies were then machined to obtain cubic sintered R-T-B based magnet bodies with sizes of 7.4 mm×7.4 mm×7.4 mm. Using some of these sintered magnet bodies thus obtained, the percentages of their ingredients (by ICP) and the percentages of the gases were measured. The results of analysis obtained in this manner are shown in the following Table 1. The analysis was carried out by ICP atomic emission spectroscopy. However, the analysis values of oxygen, nitrogen and carbon were obtained as a result of analysis with a gas analyzer.

In Table 1, "No" indicates the sample number, the column "TRE" indicates the R mole fraction, and the column "TRE'" indicates the effective rare-earth content which is obtained by subtracting the O, N and C mole fractions from the R mole fraction. More specifically, the effective rare-earth content is a value calculated by TRE−(6×O mole fraction+8×C mole fraction+10×N mole fraction). In Table 2, the column "peripheral velocity" indicates the peripheral velocity at the inner wall surface of the cylinder 3 shown in FIG. 1. The column "RH diffusion temperature" indicates the temperature to be maintained through the RH diffusion process. The column "RH diffusion time" indicates the amount of time for which the RH diffusion temperature was maintained. The column "ambient pressure" indicates the pressure when the RH diffusion process was started. The column "before diffusion" indicates the $H_{cJ}$ and $B_r$ values that were measured before the RH diffusion process. And the column "after diffusion" indicates the $H_{cJ}$ and $B_r$ values that were measured after the RH diffusion process. The sintered R-T-B based magnet bodies thus obtained had their magnetic properties before the RH diffusion process measured with a B—H tracer. As a result, $H_{cJ}$ and $B_r$ as measured after the heat treatment (at 500° C.) were as shown in the following Table 2:

TABLE 1

| No. | TRE | Nd | Dy | TRE' | O | N | C | B | Al | Cu | Co | Ga | Fe |
|---|---|---|---|---|---|---|---|---|---|---|---|---|---|
| 1 | 30.5 | 30 | 0.5 | 28.5 | 0.20 | 0.02 | 0.08 | 1 | 0.1 | 0.1 | 0.9 | 0.1 | Bal |
| 2 | 31 | 30.5 | 0.5 | 28.4 | 0.30 | 0.02 | 0.08 | 1 | 0.1 | 0.1 | 0.9 | 0.1 | Bal |
| 3 | 32 | 31.5 | 0.5 | 30.0 | 0.20 | 0.02 | 0.08 | 1 | 0.1 | 0.1 | 0.9 | 0.1 | Bal |

(unit: mass %)

TABLE 2

| | Diffusion source | | | RH diffusion condition | | | | Before diffusion | | After diffusion | |
|---|---|---|---|---|---|---|---|---|---|---|---|
| | | | | Peripheral velocity | RH diffusion temperature | RH diffusion time | Ambient pressure | HcJ | Br | HcJ | Br |
| No | Dy | Tb | Fe | (m/s) | (° C.) | (hr.) | (Pa) | (kA/m) | (T) | (kA/m) | (T) |
| 1 | 60 | | 40 | 0.04 | 850 | 5 | 5 | 1000 | 1.4 | 1250 | 1.4 |
| 2 | 60 | | 40 | 0.04 | 850 | 5 | 5 | 1020 | 1.39 | 1480 | 1.39 |
| 3 | 60 | | 40 | 0.04 | 850 | 5 | 5 | 1030 | 1.37 | 1490 | 1.37 |

Next, an RH diffusion process was carried out using the apparatus shown in FIG. 1. In this case, the cylinder had a volume of 128000 $mm^3$, the total weight of the RH diffusion sources loaded was 50 g and the total weight of the sintered R-T-B based magnet bodies loaded also was 50 g. The RH diffusion sources used had indefinite shapes with a diameter of 3 mm or less.

The RH diffusion sources were made by weighing Dy and Fe so that these elements had the predetermined composition shown in the following Table 2, melting them in an induction melting furnace, bringing the melt into contact with a water cooled copper roller rotating at a roller surface velocity of 2 m/s to obtain a melt-quenched alloy, pulverizing the alloy with a stamp mill or by hydrogen decrepitation process, and then adjusting the particle sizes to 3 mm or less using a sieve.

Figure 2:
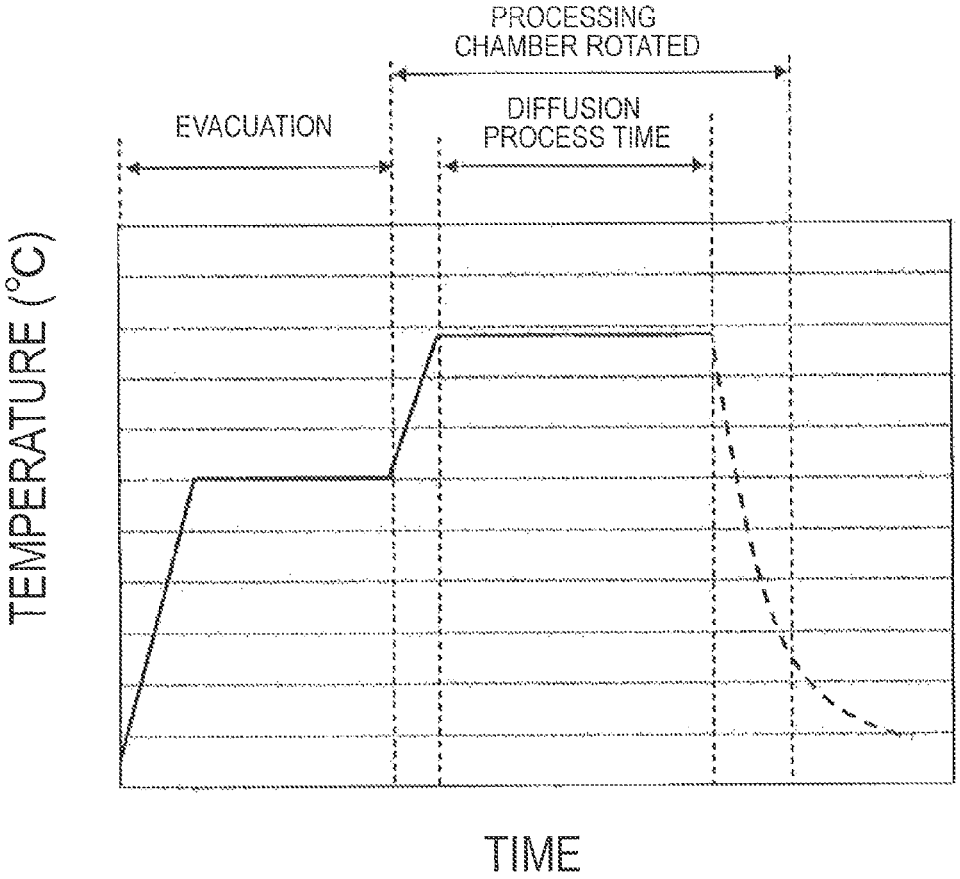
FIG. 2 A graph showing an example of a heat pattern to adopt in an RH diffusion process step.

In the diffusion process, the temperature in the processing chamber was set as shown in FIG. 2, which is a graph showing a heat pattern that represents how the temperature in the processing chamber varied after the heating process was started. In the example illustrated in FIG. 2, the pressure in the processing chamber was decreased sufficiently by carrying out evacuation. Next, after the pressure in the processing chamber reached 5 Pa by raising the pressure of the argon gas again, the temperature was raised to an RH diffusion temperature (of 850° C.) with the processing chamber rotated. If the pressure varied somewhat while the temperature was being raised, Ar gas was exhausted or supplied appropriately to maintain a pressure of 5 Pa. The temperature increase rate was approximately 10° C. per minute. When the RH diffusion temperature was reached, that temperature was maintained for a predetermined period of time. Thereafter, the heating process was stopped and the temperature was lowered to room temperature. After that, the RH diffusion sources were unloaded from the machine shown in FIG. 1, and the remaining sintered R-T-B based magnet bodies were subjected to the first heat treatment at the same ambient pressure as in the diffusion process (at 850° C. for 5 hours), and then subjected to the second heat treatment after the diffusion process (at 500° C. for 1 hour).

In this case, the sintered R-T-B based magnet body had its each side ground by 0.2 mm after the RH diffusion process to be machined into a cubic shape of 7.0 mm×7.0 mm×7.0 mm, and then had its magnetic properties measured with a B—H tracer.

$B_r$ and $H_{cJ}$ of Samples #2 and #3 which fall within the range of the present invention and Sample #1 which falls out of that range before and after the RH diffusion process are shown in Table 1. As can be seen from Table 1, if Samples #2 and #3 with an R mole fraction of 31 mass % or more were subjected to the RH diffusion process, $B_r$ did not decrease and $H_{cJ}$ increased by 460 kA/m. Samples #2 and #3 had their TRE increased, and therefore, had its $B_r$ before the diffusion decreased, compared to Sample #1. But their $B_r$ did not decrease after the RH diffusion. The difference in $H_{cJ}$ before and after the RH diffusion process was significantly greater than the increase in $H_{cJ}$ in Sample #1 which falls out of the range of the present invention. No adhesion occurred in any of these samples during the RH diffusion process.

Experimental Example 2

Effect to be Achieved Due to Difference in RH Diffusion Process Time

First, sintered R-T-B based magnets were made under the same condition as in Experimental Example 1 except the ones shown in the following Tables 3 and 4. The results of the analysis shown in Table 3 were obtained by performing ICP atomic emission spectroscopy but the component analysis values of oxygen, nitrogen and carbon were obtained with a gas analyzer. The "Dy content after diffusion" indicates the mole fraction of Dy included in the sintered magnet that has already been subjected to the RH diffusion process. If the column "adhesion" says "YES", it means that the RH diffusion sources and the sintered R-T-B based magnet bodies adhered to each other after the RH diffusion process.

The results of the analysis revealed that Sample #4 had O, N and C mole fractions of 0.2, 0.03 and 0.08 mass %, respectively. Meanwhile, Sample #5 had O, N and C mole fractions of 0.45, 0.03 and 0.09 mass %, respectively. By machining these samples, cubic sintered R-T-B based magnet bodies with sizes of 7.4 mm×7.4 mm×7.4 mm were obtained.

In Table 3, shown are the compositions of the sintered R-T-B based magnet bodies used. The results of the analysis shown in Table 3 were obtained by performing ICP atomic emission spectroscopy but the component analysis values of oxygen, nitrogen and carbon were obtained with a gas analyzer. The sintered R-T-B based magnet bodies thus obtained had their magnetic properties before the RH diffusion process measured with a B—H tracer. As a result, $H_{cJ}$ and $B_r$ after the heat treatment (at 500° C.) were as shown in the following Table 4:

TABLE 3

(unit: mass %)

| No. | TRE | Nd | Dy | TRE' | O | N | C | B | Al | Cu | Co | Ga | Fe |
|---|---|---|---|---|---|---|---|---|---|---|---|---|---|
| 4 | 31 | 30.5 | 0.5 | 28.9 | 0.20 | 0.03 | 0.08 | 1 | 0.1 | 0.1 | 0.9 | 0.1 | Bal |
| 5 | 31 | 30.5 | 0.5 | 27.3 | 0.45 | 0.03 | 0.09 | 1 | 0.1 | 0.1 | 0.9 | 0.1 | Bal |

TABLE 4

| | Diffusion source | | | RH diffusion condition: Peripheral velocity | RH diffusion temperature | RH diffusion time | Ambient pressure | | Before diffusion | | After diffusion | | Dy content after diffusion |
|---|---|---|---|---|---|---|---|---|---|---|---|---|---|
| No | Dy | Tb | Fe | (m/s) | (° C.) | (hr.) | (Pa) | Adhered? | HcJ (kA/m) | Br (T) | HcJ (kA/m) | Br (T) | (mass %) |
| 4A | 50 | | 50 | 0.04 | 900 | 1 | 8 | NO | 1020 | 1.39 | 1140 | 1.39 | 0.7 |
| 4B | 50 | | 50 | 0.04 | 900 | 2 | 8 | NO | 1020 | 1.39 | 1280 | 1.39 | 0.9 |
| 4C | 50 | | 50 | 0.04 | 900 | 5 | 8 | NO | 1020 | 1.39 | 1600 | 1.39 | 1.5 |
| 4D | 50 | | 50 | 0.04 | 900 | 12 | 8 | NO | 1020 | 1.39 | 1680 | 1.39 | 1.8 |
| 4E | 50 | | 50 | 0.04 | 900 | 20 | 8 | NO | 1020 | 1.39 | 1740 | 1.39 | 2.2 |
| 5A | 50 | | 50 | 0.04 | 900 | 1 | 8 | NO | 1020 | 1.39 | 1070 | 1.39 | 0.7 |
| 5B | 50 | | 50 | 0.04 | 900 | 2 | 8 | NO | 1020 | 1.39 | 1160 | 1.39 | 0.9 |
| 5C | 50 | | 50 | 0.04 | 900 | 5 | 8 | NO | 1020 | 1.39 | 1270 | 1.39 | 1.5 |
| 5D | 50 | | 50 | 0.04 | 900 | 12 | 8 | NO | 1020 | 1.39 | 1490 | 1.39 | 1.8 |
| 5E | 50 | | 50 | 0.04 | 900 | 20 | 8 | NO | 1020 | 1.39 | 1600 | 1.39 | 2.2 |

Figure 3:
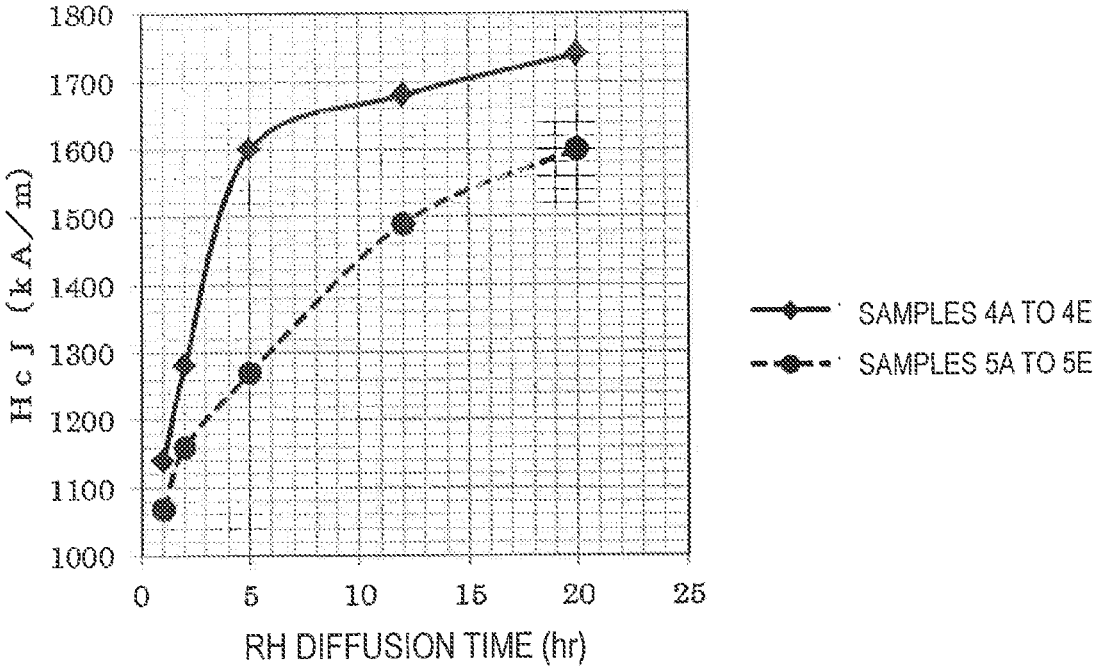
FIG. 3 A graph showing how effectively HcJ can be increased through an RH diffusion process according to an embodiment of the present invention and an RH diffusion process according to a comparative example.

To check out the influence of the RH diffusion process time, the RH diffusion process was carried out for varied RH diffusion process times as shown in this Table 4. As a result, in Samples #4 (including Samples #4A through #4E) which fall within the range of the present invention, $H_{cJ}$ increased steeply until the RH diffusion process was performed at 900° C. for five hours, and then increased gently even after that as shown in FIG. 3. In Samples #5 (including Samples #5A through #5E), on the other hand, $H_{cJ}$ increased with the process time but did not increase as steeply as in Samples #4. It took as long as 20 hours for Samples #5 to reach an $H_{cJ}$ value that was reached in only 5 hours in Samples #4.

On the other hand, the Dy content after the diffusion in Samples #4A through #4E was not different from in Samples #5A through #5E. It can be seen that by using the sintered R-T-B based magnet bodies according to an embodiment of the present invention, the heavy rare-earth element RH introduced by the RH diffusion process would diffuse through the magnet in a short time and would increase the coercivity. It should be noted that no adhesion occurred in any of these samples during the RH diffusion process.

Experimental Example 3

R Mole Fraction and Effective Rare-Earth Content Range

Sintered R-T-B based magnets were made under the same condition as in Experimental Example 1 except the ones shown in the following Tables 5 and 6. The results of the analysis shown in Table 5 were obtained by performing ICP atomic emission spectroscopy but the component analysis values of oxygen, nitrogen and carbon were obtained with a gas analyzer. The results of the analysis revealed that the O, N and C mole fractions of Samples #6 through #16 were as shown in the following Table 5. As can be seen from the results shown in the following Table 6, $B_r$ did not decrease in any of Samples #6 through #15 but $H_{cJ}$ increased in each of those samples. In Samples #7 through #15 falling within the range of the present invention, the $H_{cJ}$ value after the RH diffusion process increased by more than 560 kA/m. In Sample #16, on the other hand, the RH diffusion sources and the sintered R-T-B based magnet bodies adhered to each other, so did the sintered R-T-B based magnet bodies themselves, after the RH diffusion process.

TABLE 5

(unit: mass %)

| No. | TRE | Nd | Dy | TRE' | O | N | C | B | Al | Cu | Co | Ga | Fe |
|---|---|---|---|---|---|---|---|---|---|---|---|---|---|
| 6 | 31 | 30.5 | 0.5 | 27.7 | 0.40 | 0.03 | 0.08 | 1 | 0.1 | 0.1 | 0.9 | 0.1 | Bal |
| 7 | 31 | 30.5 | 0.5 | 28.1 | 0.35 | 0.02 | 0.08 | 1 | 0.1 | 0.1 | 0.9 | 0.1 | Bal |
| 8 | 31 | 30.5 | 0.5 | 29.6 | 0.10 | 0.02 | 0.08 | 1 | 0.1 | 0.1 | 0.9 | 0.1 | Bal |
| 9 | 31 | 30.5 | 0.5 | 29.9 | 0.05 | 0.02 | 0.08 | 1 | 0.1 | 0.1 | 0.9 | 0.1 | Bal |
| 10 | 32 | 31.5 | 0.5 | 28.8 | 0.40 | 0.02 | 0.08 | 1 | 0.1 | 0.1 | 0.9 | 0.1 | Bal |
| 11 | 32 | 31.5 | 0.5 | 29.7 | 0.20 | 0.05 | 0.08 | 1 | 0.1 | 0.1 | 0.9 | 0.1 | Bal |
| 12 | 34 | 33.5 | 0.5 | 31.9 | 0.20 | 0.03 | 0.08 | 1 | 0.1 | 0.1 | 0.9 | 0.1 | Bal |
| 13 | 36 | 35.5 | 0.5 | 33.9 | 0.20 | 0.03 | 0.08 | 1 | 0.1 | 0.1 | 0.9 | 0.1 | Bal |
| 14 | 36 | 35.5 | 0.5 | 34.5 | 0.10 | 0.03 | 0.08 | 1 | 0.1 | 0.1 | 0.9 | 0.1 | Bal |
| 15 | 37 | 36.5 | 0.5 | 35.0 | 0.20 | 0.02 | 0.08 | 1 | 0.1 | 0.1 | 0.9 | 0.1 | Bal |
| 16 | 37 | 36.5 | 0.5 | 35.6 | 0.10 | 0.02 | 0.08 | 1 | 0.1 | 0.1 | 0.9 | 0.1 | Bal |

TABLE 6

| | Diffusion source | | | RH diffusion condition: Peripheral velocity | RH diffusion temperature | RH diffusion time | Ambient pressure | Before diffusion | | After diffusion | |
|---|---|---|---|---|---|---|---|---|---|---|---|
| No | Dy | Tb | Fe | (m/s) | (° C.) | (hr.) | (Pa) | HcJ (kA/m) | Br (T) | HcJ (kA/m) | Br (T) |
| 6 | 45 | | 55 | 0.04 | 880 | 7 | 7 | 1020 | 1.39 | 1430 | 1.39 |
| 7 | 45 | | 55 | 0.04 | 880 | 7 | 7 | 1020 | 1.39 | 1580 | 1.39 |
| 8 | 45 | | 55 | 0.04 | 880 | 7 | 7 | 1020 | 1.39 | 1600 | 1.39 |
| 9 | 45 | | 55 | 0.04 | 880 | 7 | 7 | 1020 | 1.39 | 1600 | 1.39 |
| 10 | 45 | | 55 | 0.04 | 880 | 7 | 7 | 1030 | 1.37 | 1600 | 1.37 |
| 11 | 45 | | 55 | 0.04 | 880 | 7 | 7 | 1030 | 1.37 | 1600 | 1.37 |
| 12 | 45 | | 55 | 0.04 | 880 | 7 | 7 | 1040 | 1.33 | 1630 | 1.33 |
| 13 | 45 | | 55 | 0.04 | 880 | 7 | 7 | 1050 | 1.28 | 1630 | 1.28 |
| 14 | 45 | | 55 | 0.04 | 880 | 7 | 7 | 1050 | 1.28 | 1650 | 1.28 |
| 15 | 45 | | 55 | 0.04 | 880 | 7 | 7 | 1050 | 1.26 | 1660 | 1.26 |
| 16 | 45 | | 55 | 0.04 | 880 | 7 | 7 | 1050 | 1.26 | — | — |

Experimental Example 4

RH Diffusion Process Temperature Range

Sintered R-T-B based magnets were made under the same condition as in Experimental Example 1 except the ones shown in the following Tables 7 and 8. The results of the analysis shown in Table 7 were obtained by performing ICP atomic emission spectroscopy but the component analysis values of oxygen, nitrogen and carbon were obtained with a gas analyzer. The results of the analysis revealed that the O, N and C mole fractions of Samples #17 and #18 were as shown in the following Table 7.

TABLE 7

(unit: mass %)

| No. | TRE | Nd | Dy | TRE' | O | N | C | B | Al | Cu | Co | Ga | Fe |
|---|---|---|---|---|---|---|---|---|---|---|---|---|---|
| 17 | 32 | 31.5 | 0.5 | 30.0 | 0.20 | 0.02 | 0.08 | 0.99 | 0.1 | 0.1 | 0.9 | 0.1 | Bal |
| 18 | 32 | 31.5 | 0.5 | 27.7 | 0.50 | 0.05 | 0.1 | 0.99 | 0.1 | 0.1 | 0.9 | 0.1 | Bal |

On Samples #17 and #18, the RH diffusion process was carried out at multiple different temperatures (of 600° C., 700° C., 800° C., 870° C., 900° C., 970° C., 1000° C. and 1020° C.) to find how $B_r$ and $H_{cJ}$ changed and whether or not adhesion occurred. The results are shown in the following Table 8.

TABLE 8

| | Diffusion source | | | RH diffusion condition: Peripheral velocity | RH diffusion temperature | RH diffusion time | Ambient pressure | | Before diffusion | | After diffusion | |
|---|---|---|---|---|---|---|---|---|---|---|---|---|
| No | Dy | Tb | Fe | (m/s) | (° C.) | (hr.) | (Pa) | Adhered? | HcJ (kA/m) | Br (T) | HcJ (kA/m) | Br (T) |
| 17A | 50 | | 50 | 0.05 | 600 | 5 | 6 | NO | 1030 | 1.37 | 1060 | 1.37 |
| 17B | 50 | | 50 | 0.05 | 700 | 5 | 6 | NO | 1030 | 1.37 | 1260 | 1.37 |
| 17C | 50 | | 50 | 0.05 | 800 | 5 | 6 | NO | 1030 | 1.37 | 1330 | 1.37 |
| 17D | 50 | | 50 | 0.05 | 870 | 5 | 6 | NO | 1030 | 1.37 | 1510 | 1.37 |
| 17E | 50 | | 50 | 0.05 | 900 | 5 | 6 | NO | 1030 | 1.37 | 1600 | 1.37 |
| 17F | 50 | | 50 | 0.05 | 970 | 5 | 6 | NO | 1030 | 1.37 | 1600 | 1.37 |
| 17G | 50 | | 50 | 0.05 | 1000 | 5 | 6 | NO | 1030 | 1.37 | 1600 | 1.37 |
| 17H | 50 | | 50 | 0.05 | 1020 | 5 | 6 | YES | 1030 | 1.37 | — | — |
| 18A | 50 | | 50 | 0.05 | 600 | 5 | 6 | NO | 1030 | 1.37 | 1060 | 1.37 |
| 18B | 50 | | 50 | 0.05 | 700 | 5 | 6 | NO | 1030 | 1.37 | 1070 | 1.37 |
| 18C | 50 | | 50 | 0.05 | 800 | 5 | 6 | NO | 1030 | 1.37 | 1150 | 1.37 |

TABLE 8-continued

| | Diffusion source | | | RH diffusion condition | | | | | Before diffusion | | After diffusion | |
|---|---|---|---|---|---|---|---|---|---|---|---|---|
| | | | | Peripheral velocity | RH diffusion temperature | RH diffusion time | Ambient pressure | | HcJ | Br | HcJ | Br |
| No | Dy | Tb | Fe | (m/s) | (° C.) | (hr.) | (Pa) | Adhered? | (kA/m) | (T) | (kA/m) | (T) |
| 18D | 50 | | 50 | 0.05 | 870 | 5 | 6 | NO | 1030 | 1.37 | 1360 | 1.37 |
| 18E | 50 | | 50 | 0.05 | 900 | 5 | 6 | NO | 1030 | 1.37 | 1400 | 1.37 |
| 18F | 50 | | 50 | 0.05 | 970 | 5 | 6 | NO | 1030 | 1.37 | 1400 | 1.37 |
| 18G | 50 | | 50 | 0.05 | 1000 | 5 | 6 | NO | 1030 | 1.37 | 1400 | 1.37 |
| 18H | 50 | | 50 | 0.05 | 1020 | 5 | 6 | YES | 1030 | 1.37 | — | — |
| 19A | 100 | | | 0.05 | 600 | 5 | 6 | NO | 1030 | 1.37 | 1070 | 1.37 |
| 19B | 100 | | | 0.05 | 700 | 5 | 6 | NO | 1030 | 1.37 | 1280 | 1.37 |
| 19C | 100 | | | 0.05 | 800 | 5 | 6 | NO | 1030 | 1.37 | 1350 | 1.37 |
| 19D | 100 | | | 0.05 | 870 | 5 | 6 | YES | 1030 | 1.37 | — | — |
| 19E | 100 | | | 0.05 | 900 | 5 | 6 | YES | 1030 | 1.37 | — | — |
| 19F | 100 | | | 0.05 | 970 | 5 | 6 | YES | 1030 | 1.37 | — | — |
| 19G | 100 | | | 0.05 | 1000 | 5 | 6 | YES | 1030 | 1.37 | — | — |
| 19H | 100 | | | 0.05 | 1020 | 5 | 6 | YES | 1030 | 1.37 | — | — |

Comparing the results obtained from Samples #17B through #17G representing embodiments of the present invention to the ones obtained from Samples #18B through #18G representing comparative examples, it could be seen that $H_{cJ}$ increased without causing a decrease in $B_r$ in all of these Samples #17B through #17G and #18B through #18G but that if the RH diffusion time was the same, $H_{cJ}$ increased by more than 150 kA/m in Samples #17B through #17G compared to Samples #18B through #18G.

The present inventors also discovered that no adhesion occurred within the range of 700° C. to 1000° C. in any of these Samples #17B through #17G and #18B through #18G. However, if the RH diffusion process was carried out at 1020° C., adhesion did occur in Samples #17H and #18H which used RH diffusion sources according to an embodiment of the present invention. For that reason, the RH diffusion process should be carried out at a temperature of 1000° C. or less.

Also, even if RH diffusion sources according to an embodiment of the present invention were used but if the RH diffusion process was carried out at 600° C., the effect of increasing the coercivity was no different. That is why it is appropriate to carry out the RH diffusion process according to an embodiment of the present invention at a temperature of 700° C. to 1000° C.

As another comparative example, Sample #19 was subjected to the RH diffusion process under the same condition as in Sample #17 except that diffusion sources of Dy were used as alternative RH diffusion sources.

Those diffusion sources of Dy were made by turning $DyF_2$ into Dy by metallothermic reduction process so that $DyF_2$ is reduced with metal calcium, pulverizing Dy with a stamp mill or by hydrogen pulverization process, and then adjusting the particle sizes to 3 mm or less through a sieve.

The RH diffusion process was carried out at multiple different temperatures (of 600° C., 700° C., 800° C., 870° C., 900° C., 970° C., 1000° C. and 1020° C.) to find how $B_r$ and $H_{cJ}$ changed and whether or not adhesion occurred. The results are shown in the following Table 8. Specifically, when Dy was used as diffusion sources, adhesion occurred at 870° C., 900° C., 970° C., 1000° C. and 1020° C. in Samples #19D through #19H.

Comparing the results obtained from Samples #17A through #17H to the ones obtained from Samples #19A through #19H, it could be seen that in Samples #17A through #17H on which the diffusion process was carried out using a Dy—Fe alloy as diffusion sources, no adhesion occurred within the range of 700° C. to 1000° C. but the $H_{cJ}$ value was small when the RH diffusion process was carried out at 600° C., 700° C. and 800° C.

It should be noted that Dy metal, 100% of which is Dy, should not be used, because Dy metal has an oxidation and firing problem and needs to be handled in an inert gas except when it is used in the diffusion process, thus making it difficult to advance the process smoothly.

Meanwhile, sintered R-T-B based magnet bodies having the same composition as Sample #17 were subjected to the evaporation diffusion process. Specifically, those sintered magnet bodies were acid-cleaned with a 0.3% nitric acid aqueous solution, dried, and then arranged in the process vessel as disclosed in Patent Document No. 2. The process vessel was made of Mo and included a member for holding a plurality of sintered R-T-B based bodies and a member for holding two RH bulk bodies. A gap of about 5 mm to about 9 mm was left between the sintered R-T-B based magnet bodies and the RH bulk bodies. The RH bulk bodies were made of Dy with a purity of 99.9% and had sizes of 30 mm×30 mm×5 mm. Next, the process vessel was loaded into a vacuum heat treatment furnace to carry out an evaporation diffusion process. The process was carried out under the following condition. Specifically, the temperature was raised under a pressure of $1\times10^{-2}$ Pa and maintained at 900° C. for 5 hours. After that, an additional heat treatment was conducted at 900° C. for 5 hours and an aging treatment was conducted at 500° C. for 1 hour. As a result, the sintered R-T-B based magnet bodies adhered to the holders.

Experimental Example 5

RH Diffusion Source's Composition

Sintered R-T-B based magnets were made under the same condition as in Experimental Example 1 except the ones shown in the following Tables 9 and 10. The results of the analysis shown in Table 9 were obtained by performing ICP atomic emission spectroscopy but the component analysis values of oxygen, nitrogen and carbon were obtained with a gas analyzer. The results of the analysis revealed that the O, N and C mole fractions of Sample #20 were as shown in the following Table 9.

TABLE 9

| No. | TRE | Nd | Pr | TRE' | O | N | C | B | Al | Cu | Co | Ga | Fe |
|---|---|---|---|---|---|---|---|---|---|---|---|---|---|
| | | | | | | | | | | | | (unit: mass %) | |
| 20 | 31 | 29.5 | 1.0 | 28.5 | 0.30 | 0.02 | 0.06 | 0.99 | 0.1 | 0.1 | 0.9 | 0.1 | Bal |

TABLE 10

| | RH diffusion condition | | | | | | | | | | | |
|---|---|---|---|---|---|---|---|---|---|---|---|---|
| | Diffusion source | | | Peripheral velocity | RH diffusion temperature | RH diffusion time | Ambient pressure | | Before diffusion | | After diffusion | |
| | | | | | | | | | HcJ | Br | HcJ | Br |
| No | Dy | Tb | Fe | (m/s) | (° C.) | (hr.) | (Pa) | Adhered? | (kA/m) | (T) | (kA/m) | (T) |
| 20A | 70 | | 30 | 0.06 | 920 | 4 | 4 | NO | 1020 | 1.39 | 1620 | 1.385 |
| 20B | 60 | | 40 | 0.06 | 920 | 4 | 4 | NO | 1020 | 1.39 | 1620 | 1.39 |
| 20C | 50 | | 50 | 0.06 | 920 | 4 | 4 | NO | 1020 | 1.39 | 1620 | 1.39 |
| 20D | 40 | | 60 | 0.06 | 920 | 4 | 4 | NO | 1020 | 1.39 | 1620 | 1.39 |
| 20E | 25 | | 75 | 0.06 | 920 | 4 | 4 | NO | 1020 | 1.39 | 1380 | 1.39 |
| 20F | 20 | | 80 | 0.06 | 920 | 4 | 4 | NO | 1020 | 1.39 | 1370 | 1.39 |
| 20G | | 70 | 30 | 0.06 | 920 | 4 | 4 | NO | 1020 | 1.39 | 1900 | 1.385 |
| 20H | | 60 | 40 | 0.06 | 920 | 4 | 4 | NO | 1020 | 1.39 | 1900 | 1.39 |
| 20I | | 50 | 50 | 0.06 | 920 | 4 | 4 | NO | 1020 | 1.39 | 1900 | 1.39 |
| 20J | | 40 | 60 | 0.06 | 920 | 4 | 4 | NO | 1020 | 1.39 | 1900 | 1.39 |
| 20K | | 25 | 75 | 0.06 | 920 | 4 | 4 | NO | 1020 | 1.39 | 1500 | 1.39 |
| 20L | | 20 | 80 | 0.06 | 920 | 4 | 4 | NO | 1020 | 1.39 | 1480 | 1.39 |
| 20M | 30 | 30 | 40 | 0.06 | 920 | 4 | 4 | NO | 1020 | 1.39 | 1750 | 1.39 |

When the RH diffusion process was carried out within the range using RH diffusion sources in which the Dy:Fe or Tb:Fe mass ratio fell within the range of 70:30 to 20:80, the decrease in $B_r$ could be reduced to 0.005 T and $H_{cJ}$ increased by more than 350 kA/m. On the other hand, when RH diffusion sources in which the Dy:Fe or Tb:Fe mass ratio fell within the range of 60:40 to 40:60 were used, $H_{cJ}$ increased significantly without causing a decrease in $B_r$.

Experimental Example 6

Effect of Stirring Aid Member

The RH diffusion process was carried out under the same condition as in Experimental Example 5 except that the RH diffusion process and first heat treatment were carried out by using zirconia balls with a diameter of 5 mm and a weight of g as additional stirring aid members, and the magnetic properties were evaluated. The results were as shown in the following Table 11. As can be seen from Table 11, even though the RH diffusion process was carried out on Samples #21A through #21M for only a half as long a time as on Samples #20A through #20M, $H_{cJ}$ could be increased effectively in just a short time almost without causing a decrease in $B_r$. Also, comparing the results obtained from Samples #21B, #21N and #21O to each other, it could be seen that the effect of an embodiment of the present invention was also achieved no less significantly even if the ambient pressure was changed. It also turned out that chipping occurred much less frequently than in Samples #20A and #20B.

TABLE 11

| | RH diffusion condition | | | | | | | | | | | | Was |
|---|---|---|---|---|---|---|---|---|---|---|---|---|---|
| | Diffusion source | | | Peripheral velocity | RH diffusion temperature | RH Diffusion time | Ambient Pressure | | Before diffusion | | After diffusion | | Stirring aid |
| | | | | | | | | | HcJ | Br | HcJ | Br | member |
| No | Dy | Tb | Fe | (m/s) | (° C.) | (hr.) | (Pa) | Adhered? | (kA/m) | (T) | (kA/m) | (T) | used? |
| 21A | 70 | | 30 | 0.06 | 920 | 2 | 4 | NO | 1020 | 1.39 | 1620 | 1.385 | YES |
| 21B | 60 | | 40 | 0.06 | 920 | 2 | 4 | NO | 1020 | 1.39 | 1620 | 1.39 | YES |
| 21C | 50 | | 50 | 0.06 | 920 | 2 | 4 | NO | 1020 | 1.39 | 1620 | 1.39 | YES |
| 21D | 40 | | 60 | 0.06 | 920 | 2 | 4 | NO | 1020 | 1.39 | 1620 | 1.39 | YES |
| 21E | 25 | | 75 | 0.06 | 920 | 2 | 4 | NO | 1020 | 1.39 | 1380 | 1.39 | YES |
| 21F | 20 | | 80 | 0.06 | 920 | 2 | 4 | NO | 1020 | 1.39 | 1370 | 1.39 | YES |
| 21G | | 70 | 30 | 0.06 | 920 | 2 | 4 | NO | 1020 | 1.39 | 1900 | 1.385 | YES |

TABLE 11-continued

| | Diffusion source | | | RH diffusion condition: Peripheral velocity | RH diffusion temperature | RH Diffusion time | Ambient Pressure | | Before diffusion | | After diffusion | | Was Stirring aid member used? |
|---|---|---|---|---|---|---|---|---|---|---|---|---|---|
| No | Dy | Tb | Fe | (m/s) | (° C.) | (hr.) | (Pa) | Adhered? | HcJ (kA/m) | Br (T) | HcJ (kA/m) | Br (T) | |
| 21H | | 60 | 40 | 0.06 | 920 | 2 | 4 | NO | 1020 | 1.39 | 1900 | 1.39 | YES |
| 21I | | 50 | 50 | 0.06 | 920 | 2 | 4 | NO | 1020 | 1.39 | 1900 | 1.39 | YES |
| 21J | | 40 | 60 | 0.06 | 920 | 2 | 4 | NO | 1020 | 1.39 | 1900 | 1.39 | YES |
| 21K | | 25 | 75 | 0.06 | 920 | 2 | 4 | NO | 1020 | 1.39 | 1500 | 1.39 | YES |
| 21L | | 20 | 80 | 0.06 | 920 | 2 | 4 | NO | 1020 | 1.39 | 1480 | 1.39 | YES |
| 21M | 30 | 30 | 40 | 0.06 | 920 | 2 | 4 | NO | 1020 | 1.39 | 1750 | 1.39 | YES |
| 21N | 60 | | 40 | 0.06 | 920 | 2 | 1 | NO | 1020 | 1.39 | 1620 | 1.39 | YES |
| 21O | 60 | | 40 | 0.06 | 920 | 2 | 1000 | NO | 1020 | 1.39 | 1620 | 1.39 | YES |

Experimental Example 7

Effect to be Achieved Due to Difference in Ambient Pressure

Sintered R-T-B based magnets were made under the same condition as in Experimental Example 1 except the ones shown in the following Tables 12 and 13. The results of the analysis shown in Table 12 were obtained by performing ICP atomic emission spectroscopy but the component analysis values of oxygen, nitrogen and carbon were obtained with a gas analyzer. The results of the analysis revealed that the O, N and C mole fractions of Sample #22 were as shown in the following Table 12. To check out the influence of the ambient pressure during the RH diffusion process, the RH diffusion process was carried out at various ambient pressures as shown in the following Table 13. As a result, as long as the pressure fell within the range of 0.1 Pa to 100000 Pa (in Samples #22A through #22G), $H_{cJ}$ increased irrespective of the pressure.

TABLE 12

(unit: mass %)

| No. | TRE | Nd | Pr | Dy | TRE' | O | N | C | B | Al | Cu | Co | Ga | Fe |
|---|---|---|---|---|---|---|---|---|---|---|---|---|---|---|
| 22 | 33 | 31.5 | 1.0 | 0.5 | 31.0 | 0.20 | 0.02 | 0.08 | 1.01 | 0.1 | 0.1 | 0.9 | 0.1 | Bal |

TABLE 13

| | Diffusion source | | | RH diffusion condition: Peripheral velocity | RH diffusion temperature | RH diffusion time | Ambient pressure | | Before Diffusion | | After diffusion | |
|---|---|---|---|---|---|---|---|---|---|---|---|---|
| No | Dy | Tb | Fe | (m/s) | (° C.) | (hr.) | (Pa) | Adhered? | HcJ (kA/m) | Br (T) | HcJ (kA/m) | Br (T) |
| 22A | 55 | | 45 | 0.07 | 890 | 6 | 0.1 | NO | 1035 | 1.35 | 1600 | 1.35 |
| 22B | 55 | | 45 | 0.07 | 890 | 6 | 0.2 | NO | 1035 | 1.35 | 1600 | 1.35 |
| 22C | 55 | | 45 | 0.07 | 890 | 6 | 1 | NO | 1035 | 1.35 | 1600 | 1.35 |
| 22D | 55 | | 45 | 0.07 | 890 | 6 | 3 | NO | 1035 | 1.35 | 1600 | 1.35 |
| 22E | 55 | | 45 | 0.07 | 890 | 6 | 10 | NO | 1035 | 1.35 | 1600 | 1.35 |
| 22F | 55 | | 45 | 0.07 | 890 | 6 | 100 | NO | 1035 | 1.35 | 1600 | 1.35 |
| 22G | 55 | | 45 | 0.07 | 890 | 6 | 100000 | NO | 1035 | 1.35 | 1600 | 1.35 |

Experimental Example 8

Effect to be Achieved Due to Difference in Peripheral Area Velocity

Sintered R-T-B based magnets were made under the same condition as in Experimental Example 1 except the ones shown in the following Tables 14 and 15. The results of the analysis shown in Table 14 were obtained by performing ICP atomic emission spectroscopy but the component analysis values of oxygen, nitrogen and carbon were obtained with a gas analyzer. The results of the analysis revealed that the O, N and C mole fractions of Sample #23 were as shown in the following Table 14.

To check out the influence of the rotational velocity of the processing system during the RH diffusion process, the RH diffusion process was carried out at various ambient pressures as shown in the following Table 15. As a result, when the peripheral velocity was 0.005 m/s (in Sample #23A), adhesion occurred. However, there was no significant influence as long as the peripheral velocity fell within the range of 0.1 m/s to 0.5 m/s (in Samples #23B through #23F).

TABLE 14

| No. | TRE | Nd | Dy | TRE' | O | N | C | B | Al | Cu | Co | Ga | Fe |
|---|---|---|---|---|---|---|---|---|---|---|---|---|---|
| | | | | | | | | | | | | (unit: mass %) | |
| 23 | 31 | 30.5 | 0.5 | 29.0 | 0.20 | 0.01 | 0.09 | 0.99 | 0.1 | 0.1 | 0.9 | 0.1 | Bal |

TABLE 15

| | Diffusion source | | | RH diffusion condition: Peripheral velocity | RH diffusion temperature | RH diffusion time | Ambient pressure | | Before Diffusion | | After diffusion | |
|---|---|---|---|---|---|---|---|---|---|---|---|---|
| No | Dy | Tb | Fe | (m/s) | (° C.) | (hr.) | (Pa) | Adhered? | HcJ (kA/m) | Br (T) | HcJ (kA/m) | Br (T) |
| 23A | 60 | | 40 | 0.005 | 900 | 6 | 5 | YES | 1020 | 1.39 | — | — |
| 23B | 60 | | 40 | 0.01 | 900 | 6 | 5 | NO | 1020 | 1.39 | 1610 | 1.39 |
| 23C | 60 | | 40 | 0.04 | 900 | 6 | 5 | NO | 1020 | 1.39 | 1610 | 1.39 |
| 23D | 60 | | 40 | 0.1 | 900 | 6 | 5 | NO | 1020 | 1.39 | 1610 | 1.39 |
| 23E | 60 | | 40 | 0.2 | 900 | 6 | 5 | NO | 1020 | 1.39 | 1610 | 1.39 |
| 23F | 60 | | 40 | 0.5 | 900 | 6 | 5 | NO | 1020 | 1.39 | 1610 | 1.39 |

Experimental Example 9

Effect to be Achieved Due to Difference in Composition Between Sintered R-T-B Based Magnet Bodies Sintered R-T-B based magnets were made under the same condition as in Experimental Example 1 except the ones shown in the following Tables 16 and 17. The results of the analysis shown in Table 16 were obtained by performing ICP atomic emission spectroscopy but the component analysis values of oxygen, nitrogen and carbon were obtained with a gas analyzer. The results of the analysis revealed that the O, N and C mole fractions of Samples #24 to #30 were as shown in the following Table 16. To check out the influence of the RH diffusion process time, the RH diffusion process was carried out with the Dy mole fraction changed in the R mole fraction of the sintered R-T-B based magnet bodies. As a result, the effect of increasing $H_{cJ}$ diminished as the Dy mole fraction increased (in Samples #24 to #30).

TABLE 16

| No. | TRE | Nd | Dy | TRE' | O | N | C | B | Al | Cu | Co | Ga | Fe |
|---|---|---|---|---|---|---|---|---|---|---|---|---|---|
| | | | | | | | | | | | | (unit: mass %) | |
| 24 | 31 | 30.5 | 0.5 | 29.5 | 0.10 | 0.03 | 0.08 | 1 | 0.1 | 0.1 | 0.9 | 0.1 | Bal |
| 25 | 31 | 30 | 1 | 29.6 | 0.10 | 0.02 | 0.08 | 1 | 0.1 | 0.1 | 0.9 | 0.1 | Bal |
| 26 | 31 | 29.5 | 1.5 | 29.6 | 0.10 | 0.02 | 0.08 | 1 | 0.1 | 0.1 | 0.9 | 0.1 | Bal |
| 27 | 31 | 29 | 2 | 29.6 | 0.10 | 0.02 | 0.08 | 1 | 0.1 | 0.1 | 0.9 | 0.1 | Bal |
| 28 | 31 | 26.5 | 4.5 | 29.6 | 0.10 | 0.02 | 0.08 | 1 | 0.1 | 0.1 | 0.9 | 0.1 | Bal |
| 29 | 31 | 24 | 7 | 29.3 | 0.10 | 0.05 | 0.08 | 1 | 0.1 | 0.1 | 0.9 | 0.1 | Bal |
| 30 | 31 | 21 | 10 | 29.5 | 0.10 | 0.03 | 0.08 | 1 | 0.1 | 0.1 | 0.9 | 0.1 | Bal |

TABLE 17

| | Diffusion source | | | RH diffusion condition: Peripheral velocity | RH diffusion temperature | RH Diffusion time | Ambient pressure | | Before Diffusion | | After diffusion | |
|---|---|---|---|---|---|---|---|---|---|---|---|---|
| No | Dy | Tb | Fe | (m/s) | (° C.) | (hr.) | (Pa) | Adhered? | HcJ (kA/m) | Br (T) | HcJ (kA/m) | Br (T) |
| 24 | 45 | | 55 | 0.03 | 920 | 7 | 15 | NO | 1020 | 1.39 | 1430 | 1.39 |
| 25 | 45 | | 55 | 0.03 | 920 | 7 | 15 | NO | 1100 | 1.38 | 1500 | 1.38 |
| 26 | 45 | | 55 | 0.03 | 920 | 7 | 15 | NO | 1160 | 1.37 | 1650 | 1.37 |
| 27 | 45 | | 55 | 0.03 | 920 | 7 | 15 | NO | 1320 | 1.36 | 1700 | 1.36 |
| 28 | 45 | | 55 | 0.03 | 920 | 7 | 15 | NO | 1610 | 1.3 | 1940 | 1.3 |
| 29 | 45 | | 55 | 0.03 | 920 | 7 | 15 | NO | 1900 | 1.25 | 2180 | 1.25 |
| 30 | 45 | | 55 | 0.03 | 920 | 7 | 15 | NO | 2400 | 1.18 | 2620 | 1.18 |

Even though the heat pattern shown in FIG. 2 is supposed to be put into practice in the diffusion process according to an embodiment of the present invention described above, this is just an example and any of various other patterns may be adopted as well. Also, the evacuation process may be carried out until the diffusion process is finished and until the sintered magnet bodies are cooled sufficiently.

INDUSTRIAL APPLICABILITY

According to an embodiment of the present invention, a sintered R-T-B based magnet can be produced so that its $B_r$ and $H_{cJ}$ are both high. Thus, a sintered magnet according to an embodiment of the present invention can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
3 cylinder (processing chamber) of stainless steel
4 heater
5 cap
6 exhaust system

The invention claimed is:

1. A method for producing a sintered magnet, the method comprising the steps of:

providing a sintered R-T-B based magnet body, of which the R mole fraction that is defined by the content of a rare-earth element falls within the range of 31 mass % to 37 mass %;

providing an RH diffusion source including a heavy rare-earth element RH, which is at least one of Dy and Tb, and including a volume percentage of an $RHFe_2$ compound and/or an $RHFe_3$ compound of 90% or more;

loading the sintered magnet body and the RH diffusion source into a processing chamber so that the magnet body and the diffusion source are movable relative to each other and readily brought close to, or in contact with, each other; and performing an RH diffusion process by conducting a heat treatment on the sintered magnet body and the RH diffusion source at a process temperature of 870° C. to 970° C. and at an internal processing pressure of $10^{-2}$ Pa to atmospheric pressure while rotating the processing chamber at a peripheral velocity of 0.01 m/s or more to continuously or discontinuously move the sintered magnet body and the RH diffusion source in the processing chamber; wherein the sintered magnet body has an effective rare-earth content of 28 mass % to 35 mass %, in which the effective rare-earth content is defined by the following equation:

$$\text{the effective rare-earth content} = \text{the R mole fraction} - (6\times\text{O mole fraction} + 8\times\text{C mole fraction} + 10\times\text{N mole fraction}),$$

where the O mole fraction is an oxygen content of the sintered magnet body, the C mole fraction is a carbon content of the sintered magnet body, and the N mole fraction is a nitrogen content of the sintered magnet body.

* * * * *